US005413276A

United States Patent [19]

Sheffer

[11] Patent Number: 5,413,276

[45] Date of Patent: May 9, 1995

[54] PLURAL-COMPONENT ONE-PIECE SHIPPING AND RETAIL DISPLAY CARTON

[75] Inventor: Phil B. Sheffer, Thomasville, Pa.

[73] Assignee: Triangle Container Corporation, Philadelphia, Pa.

[21] Appl. No.: 306,178

[22] Filed: Sep. 14, 1994

[51] Int. Cl.[6] ..... B65D 5/486

[52] U.S. Cl. ..... 229/120.11; 206/44 R; 229/120.03; 229/120.18; 229/164; 229/917

[58] Field of Search ..... 229/120.03, 120.11, 229/120.18, 143, 164, 240, 917; 206/44 R

[56] References Cited

U.S. PATENT DOCUMENTS

| | | | |
|---|---|---|---|
| 1,102,820 | 7/1914 | Thompson | 229/143 |
| 1,375,127 | 4/1921 | Bliss | 229/143 |
| 2,457,291 | 12/1948 | Wenzel | 229/120.18 |
| 2,632,594 | 3/1953 | Nelson | 229/120.18 |
| 3,347,356 | 10/1967 | Kossnar | 229/120.18 |
| 4,053,101 | 10/1977 | Hart, Jr. | 229/164 |
| 4,213,559 | 7/1980 | Meyers | 229/120.18 |
| 5,048,690 | 9/1991 | Zimmerman | 229/120.18 |

*Primary Examiner*—Gary E. Elkins

*Attorney, Agent, or Firm*—Eckert Seamans Cherin & Mellott

[57] ABSTRACT

A carton is cut out and foldably formed from an integral piece of corrugated paperboard or similar sheet material, and has foldable bottom flaps and foldable closure flaps attached to panels forming side walls. Some of the panels define sidewalls forming a rectilinear carton, and at least one panel defines a partition dividing the carton into at least two compartments. Another panel defines a front wall of the carton, and has openings permitting access through the front wall to the compartments. The closure flaps have flanges which cover the access openings during shipping and inventory storage of the closed carton. The closure flaps are defined by fold lines that are weakened by scoring, perforating or the like, and are easily severed at the weakened fold lines. The carton can be assembled and folded flat, and erected for closure of the bottom, loading with product, and closure of the top. By removing the top closure flaps, the carton is converted to a display permitting customers to access the compartments through the openings in the front wall.

13 Claims, 3 Drawing Sheets

PLURAL-COMPONENT ONE-PIECE SHIPPING AND RETAIL DISPLAY CARTON

BACKGROUND OF THE INVENTION

1. Field of the Invention

The invention relates to packing and shipping cartons, and in particular concerns a plural-compartment carton formed from an integral flat piece of a sheet. The sheet is cut to form panels, and folded to provide certain partitioning and access features. When erected the carton has plural access openings in the front wall for access to internal compartments, for use as a display carton on retail shelves and the like. Flange portions of closure flaps cover the access openings during closure and shipping. The closure flaps can be removed for retail-display use of the carton.

2. Prior Art

A two-compartment packing and shipping carton is advantageously used, for example in the candy packing industry, for packing two complementary products. In the example of candy, the two compartments can be used for comparable products with nuts and without nuts, respectively. Various other examples of alternative choice products are also possible. A known two-compartment container for shipping and display of alternative products comprises the combination of a separate cap-like top, which is relatively shallow, with a deep box-like bottom.

At the packing line, the box-like bottom is filled with material, such as bags or bars of candy. The cap-like top is placed on and affixed to the box-like bottom for shipping or storage.

It would be advantageous for purposes of efficiency if a carton could be formed from an integral piece of stock such as corrugated paperboard or the like, rather than made from separate pieces. Such a carton could be cut, perforated or similarly subdivided to define panels, and folded to form and close the carton. However, this should not unduly complicate manufacture, packing, handling or use of the carton. Considering the needs for multiple compartments, access to the interior for packing and later for access to extract the product, these objectives can be difficult to achieve in a straightforward manner. Whereas the manufacture, packing and handling of the known two-piece carton is already rather complicated, changes to the carton configuration presents a risk of undue complication and expense.

For example, the known two-piece carton is customarily handled several times between manufacture and retail use. The manufacturer, packer, shipper, retailer and customer all have their particular needs and objectives. The known two-piece carton has been developed in an attempt to serve the convenience of each.

The manufacturer of the known carton typically forms the parts only partly into the fully-assembled and erected state of the finished carton. The manufacture typically forms at least some of the folds in the pieces and affixes some of the joints by glue, staple or tape. However, it is most convenient for the manufacturer to leave the carton pieces in a flat or folded collapsed condition, to conserve space for shipping to the packer. For example, the parts of the partially formed carton can be shipped with the box pan folded in half and collapsed flat. This configuration is compact, allowing a number of the cartons or parts of cartons to be stacked flat.

The packer unfolds the box-like bottom piece to erect it. This may include closing the bottom flaps using glue, staples, tape or the like, or the carton can have a self-erecting bottom. In any event, after erecting the box the packer fills the box-like bottom with product, and forms and attaches the top to the bottom to close the package for shipping or storage.

The retailer opens the carton sufficiently to enable customers to access the contents, while the product remains substantially housed in the carton and does not spill out. The retailer seeks also to display the product attractively and reasonably prominently, to encourage selection by the customers.

What is needed is an improved plural-compartment packing and shipping carton that serves all these objectives efficiently and at minimum expense, preferably using a single integral flat piece of paperboard or the like, to provide a carton that is quickly, easily and inexpensively made, that is durable for handling, and that provides an attractive display permitting ready access to the product.

SUMMARY OF THE INVENTION

It is an object of the invention to make a plural-compartment, packing and shipping carton from an integral flat piece of corrugated paperboard or the like, with foldably attached closure flaps.

It is another object of the invention to provide the above carton with means for opening a front sidewall of the carton at its destination, for access to separate compartments such that the product can be displayed and extracted.

It is a further object of to the invention to shape and arrange the above closure flaps with flanges that cover the access openings during shipping.

It is still another object of the invention to provide a multi-compartment product that serves the separate needs of the manufacturer, the packer, the shipper or shippers, the retailer and the customer.

These and other aspects and objects are provided according to the invention in a one-piece shipping, packing and retail-display carton. The carton is formed from an integral piece of corrugated paperboard or the like and has foldably attached closure flaps and foldably attached bottom flaps. More particularly, the carton includes a plurality of panels foldably attached to one another and extending between preferably aligned parallel upper and lower edges. The carton can comprises six panels which fold up to make the vertical walls of the upright assembled carton. It is further preferred that an end one of the panels defines a partition in the carton. The partition thus divides the carton into two compartments.

The closure flaps are foldably attached to the upper edges of those two of the panels that define the left and right sidewalls of the carton. The bottom flaps, on the other hand, are more generally foldably attached to the lower edges of most of the panels such that some of the bottom flaps overlay others in the erected carton. Preferably, every panel but the one that defines the partition carries a foldably attached bottom flap. Adjacent bottom flaps overlay one another and opposite bottom flaps abut edgewise.

The carton is cut from a flat piece of the corrugated paperboard or other sheet material, and is foldable to a collapsed state in which tab portions of the panels are overlapped and affixed together. These tab portions can be affixed by an adhesive, and/or by fasteners such as staples, tape, and so on. The collapsed state of the carton is obtained essentially along two folds. Two outer portions are respectively folded back over onto and joined midway over a central portion. The collapsed cartons can be stacked and otherwise are easily handled in bulk by a shipper moving the carton from a manufacturer to a packer.

From the collapsed state, the carton is erected to its open state and the bottom flaps are folded reside in a plane perpendicular to the panels. The bottom flaps are affixed to one another, whereupon the carton is structurally stable. In the open state, the panels define the sidewalls of the carton and a partition within the carton. The carton in the open state is in condition to be loaded with product through the top and/or front.

After the open carton is loaded, panels forming removable closure flaps are folded to a closed position and affixed to the panels, thereby closing the top and front of the carton.

The panel that defines a front sidewall for the carton is formed with two openings which permit access to the respective two compartments of the carton, separated by the partition panel. The closure flaps are foldable into an inverted-U shape and are arranged and sized to cover the openings in the closed state of the carton.

The closure flaps preferably are foldably attached along weakened fold lines formed by scoring or perforation or the like. Thus, the closure flaps readily can be severed in the closed state of the box. This enables access to the product through the openings in the front wall, and provides for an attractive and accessible product display.

An advantageous aspect of this carton is that the carton is cut and formed from an integral piece of flat stock, such as corrugated paperboard or the like. Thus all the panels, including the foldably attached bottom and closure flaps as well as the partition and sidewall panels, are attached to one another. Now separate lid is required and the overall structure of the carton can be controlled easily due to control of the cuts and folds.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIGS. 4–8 show a method of making and using the carton, wherein FIG. 4 is a view corresponding to FIG. 3 except that one carton is moving in the direction of the arrow and is folded partly open;

FIG. 5 is a view corresponding to FIG. 4 except that the bottom flaps have been folded and taped closed;

FIG. 6 is a view corresponding to FIG. 5 except that the carton is shown upright for loading;

FIG. 7 is a view corresponding to FIG. 6 except that the closure flaps are folded and taped closed; and, FIG. 8 is a view corresponding to FIG. 7 except that the closure flaps are removed for use of the carton as a display container.

DETAILED DESCRIPTION OF THE PREFERRED EMBODIMENTS

Figure 1:
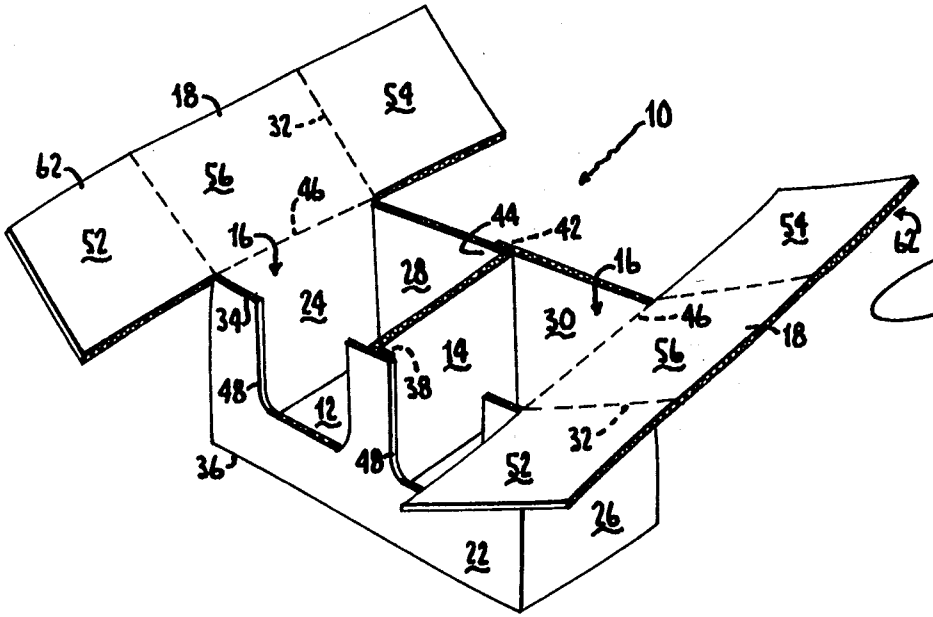
FIG. 1 is a perspective view of a two-compartment, one-piece, shipping and retail-display carton according to the invention, shown erected and in the open state, ready to be loaded with product.

FIG. 1 shows a two-compartment, one-piece shipping and retail display carton 10 according to the invention, shown erected and open. The carton 10 in the open state defines a rectilinear box shape having horizontal bottom flaps 12, a vertical partition 14 dividing the carton 10 into two compartments 16, removable closure flaps 18, and four vertical sidewalls 22–30. The sidewalls 22–30 typically are vertical when the carton 10 is deployed for loading and/or retail display. However, the carton 10 can be oriented and/or deployed otherwise. Accordingly, terms like "horizontal" and "vertical", "top" and "bottom", "upper" and "lower", "left" and "right", and so on, are used merely for convenience in this description and are not intended to limit the respective panels and/or carton 10 to any particular orientation.

Figure 2:
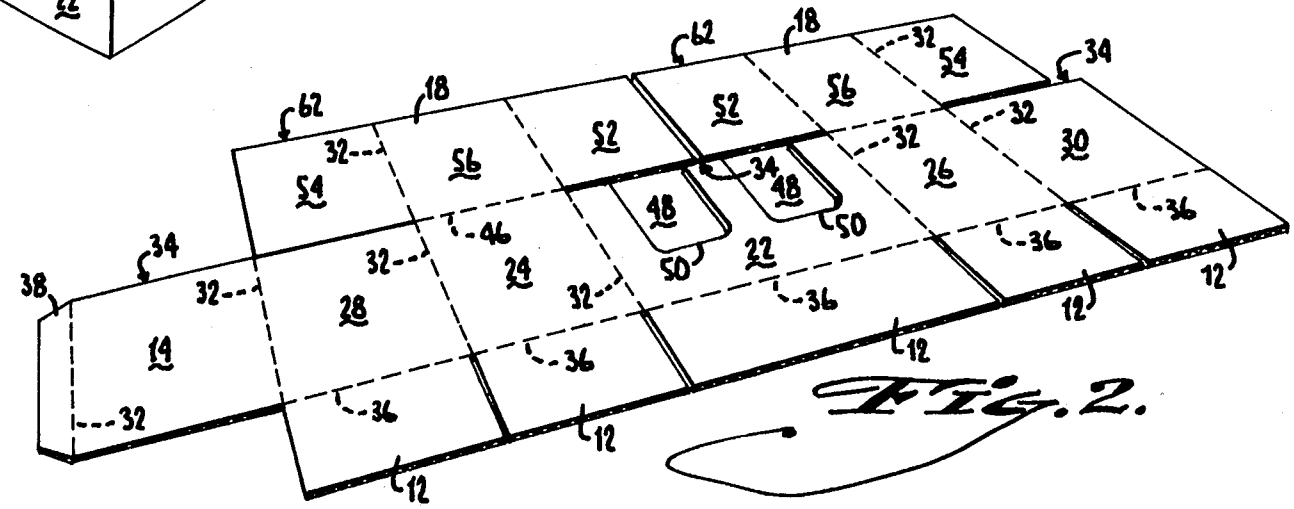
FIG. 2 is a view corresponding to FIG. 1 except that the carton is laid out flat, being cut from one piece of a sheet of corrugated paperboard, fold lines being shown in broken lines.

FIG. 2 shows the panels of carton 10 laid flat, as it appears after being cut from an integral piece of sheet stock such as corrugated paperboard or the like. Carton 10 as shown in FIG. 2 includes six panels 14, 22, 24, 26, 28 and 30, that are foldably attached to one another along fold lines 32. The fold lines 32 can be weakened portions of the sheet, which for corrugated paperboard preferably are formed by creasing the sheet with a compressive force. The fold lines 32 on the panels 14 and 22–30 generally are parallel and extend between aligned upper edges 34 and lower edges 36, respectively, which are coextensive and parallel.

Comparing FIGS. 1 and 2, panel 22 defines a front sidewall of the carton 10. Front panel 22 is flanked by opposite panels 24 and 26 which define the left and right sidewalls. Flanking the left and right sidewall panels 24 and 26 are two other panels 28 and 30 that together define a back sidewall. An end panel 14 defines the partition in the carton 10, that extends across the open interior, preferably parallel to left and right sidewall panels 24, 26.

Partition panel 14 terminates in a tab portion 38 that is foldable to a right angle for abutting against and affixing to the inner side of front sidewall 22, preferably in the middle. End panel 30, which is on the end opposite from partition panel 14 as laid flat, and which engages panel 28 at its junction with partition panel 14 when erected, has an overlapping portion 42 (See FIG. 1) defined on its right edge-margin for placement against a corresponding portion 44 of panel 28. Panels 28 and 30 together define the back sidewall of the carton and support partition 14.

As shown in FIG. 2, panels 22–30 that define the front, back, and left and right sidewalls, respectively, are alike in that each is foldably attached to a corresponding bottom flap 12 at the respective lower edge 36. Adjacent bottom flaps 12 are cut from one another along their respective left and right edges, the cuts aligning with the fold lines 32. Each of the two panels 24 and 26 that define either the left or the right sidewall is foldably attached to one removable closure flap 18 along the upper edge 34/46 of that panel. The fold lines 46 between the closure flaps 18 and the two panels 24 and 26 differ from fold lines 32 or 36 because the fold lines 46 preferably are weakened by being scored or perforated so that the closure flaps 18 easily tear off along the upper edges 34/46, to open carton 10 for display.

Panel 22 forming the front sidewall has a pair of cut out openings 48 that extend from the upper edge 34 to a lower boundary 50, spaced somewhat from the lower edge 36 of panel 22. FIG. 1 shows that these openings 48 define access openings through the front sidewall 22 to each compartment 16 of the carton 10. To cover these openings 48 during shipping, closure flaps 18 include appropriately sized front and back flange portions 52 (and back flange portions 54, preferably of equal size), that are foldably attached to a central main portion 56 along fold lines 32. Portions 56 together form the top wall of carton 10.

FIGS. 2–8 show carton 10 in progressive stages of assembly and use. During these stages, it is customary in the packing industry that carton 10 is handled by different parties who effect assembly, loading and closing, opening, display and access to the product contained in the carton. Features of carton 10 provide advantages for each of the parties in turn.

Figure 3:
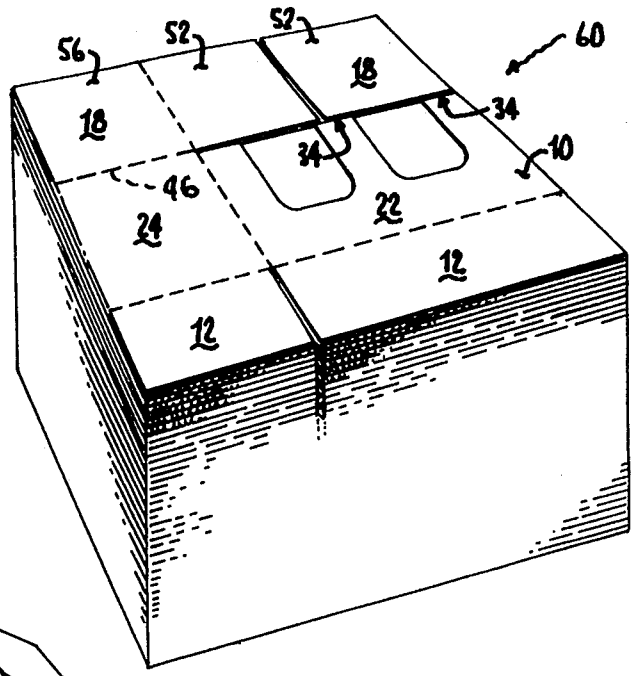
FIG. 3 is a view corresponding to FIG. 1 except that the carton is collapsed and stacked with other like collapsed cartons.

FIGS. 2 and 3 correspond to production and shipping steps of carton 10, typically in the hands of carton manufacturer. The manufacturer preferably forms the flat cutout 10 as shown in FIG. 2, for example by die cutting. The cut flat blank is folded and assembled into a collapsed state as shown in FIG. 3, and can be stacked in quantity of cartons compactly collapsed in a stack 60 as shown.

The blank is folded on diagonally opposite corners of carton 10, for example on the fold lines between panels 22 and 26, and between panels 24 and 28. The attachment of partition 14 to front panel 22 on the inside of the front wall, and the attachment of panels 28 and 30, together forming the rear wall, can be made prior to or when collapsing carton 10 into the folded state. In this state, the cartons can be handled in bulk, e.g., by a shipper who transfers the stacks 60 from the manufacturer to a packer.

Figure 5:
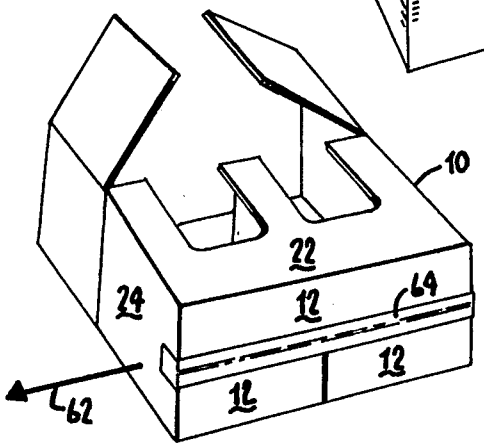
Figure 4:
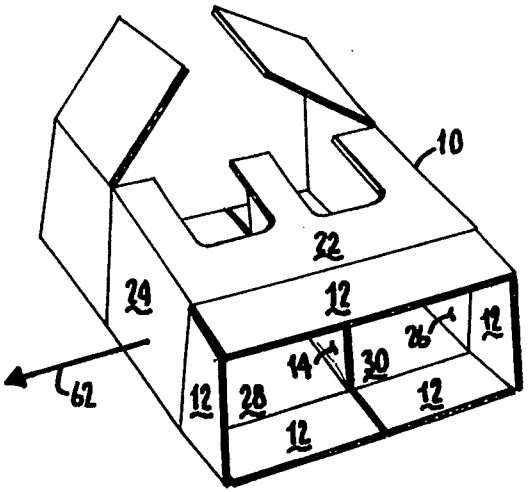
Figure 6:
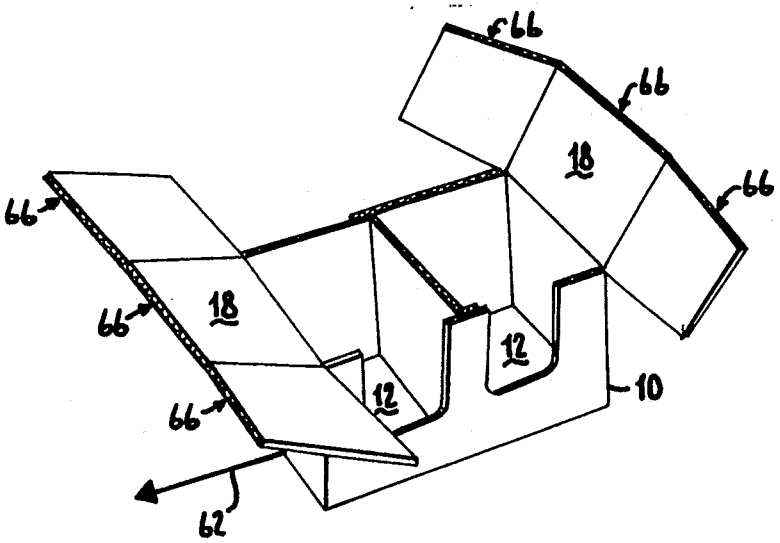
Figure 7:
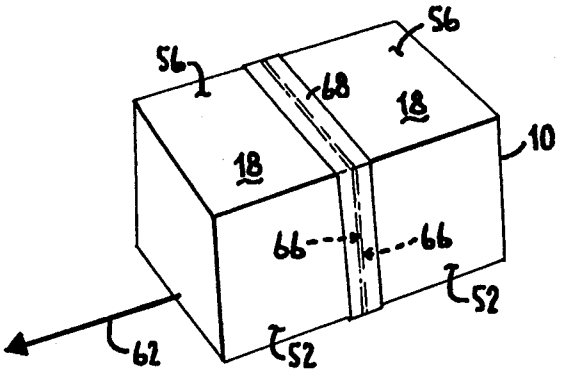

FIGS. 4–7 show the erection and loading steps, typically accomplished by the packer. The packer generally unstacks one carton 10 from the stack 60 in FIG. 3, folds it out as shown in FIG. 4, folds and attaches the bottom flaps 12 as shown in FIG. 5, and stands the carton 10 upright as shown in FIG. 6 to be loaded with product. After loading, closure flaps 18 are folded closed and attached as shown in FIG. 7. The packed and closed carton 10 is ready for shipping or inventory storage and the like.

Figure 8:
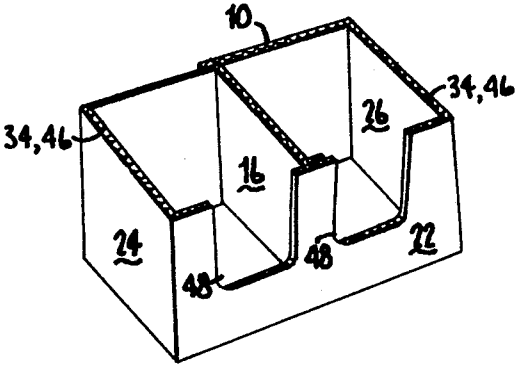

The retailer uses the carton 10 for placement and display of the product in a retail setting such as on a counter or retail shelf (not shown). As shown in FIG. 8, the retailer removes the top flaps 18 and flanges 52, or at least removes the front flanges 52 over openings 48, to display and to provide access to the product.

More particularly, and with reference to FIG. 2, the manufacturer preferably makes the cut out blank 10 from an integral piece of corrugated paperboard or the like. The blank 10 is folded into the collapsed position (e.g., FIG. 3) by the following steps. The end panel 14 defining the partition together with and the adjacent panel 28 are folded as a unit counterclockwise in FIG. 2 around the fold line 32 between panels 28 and 24, until panels 14, 28 rest against the next two panels 24 and 22. This fold brings partition tab portion 38 into alignment with the front sidewall panel 22 at a position midway on the inside of front sidewall panel 22, and between the two openings 48. The tab portion 38 is bonded or fastened in place by a suitable adhesive or a fastener, one or more staples, by tape, etc.

The opposite end panel 30 together with the adjacent panel 26 are then folded as a unit clockwise in FIG. 2, around the fold line 32 between panels 22 and 26, until they rest against the front panel 22, partly overlapping partition panel 14. This fold brings the overlapping portion 42 (FIG. 1) against the corresponding portion 44 (FIG. 1), and the two portions 42 and 44 likewise are fixed together by glue, staples, tape or the like. As a result, the carton 10 is formed but for the top and bottom closures, and is in the collapsed state shown in FIG. 3.

As collapsed, the bottom flaps 12 are coplanar with their respective attached sidewall panel, and the closure flaps 18 are similarly positioned, with main portions 56 coplanar with the corresponding left or right sidewall panel to which they are attached. The front flange portions 52 reside adjacent to the upper edge 34 of the panel 22 that defines the front sidewall, but are not attached to panel 22. The back flange portions 54 (not in view in FIG. 3) are positioned adjacent the corresponding upper edges 34 of the panels 28 and 30 that together define the back sidewall. Thus, in the collapsed position the front and rear flange portions 52 and 54 of the closure flaps 18 are generally coplanar with the corresponding adjacent front or rear sidewall panel.

FIG. 4–7 detail the steps of forming a closed carton (i.e, FIG. 7) from a collapsed carton (FIG. 3). These steps are customarily performed on the packer's process line. The packer receives collapsed cartons 10 in stacks 60 as shown in FIG. 3, and removes a carton 10 from the stack 60 to supply a process line in the direction of arrow 62 in FIGS. 4–7.

In FIG. 4, the carton 10 is opened up from its collapsed, parallelogram shape until panels 14, 24 and 26, defining the partition and left and right sidewalls, are oriented perpendicular to the panels defining the front and back sidewalls 22, and 28 and 30. The bottom flaps 12 are carried along, generally coplanar with the respective panel to which they are attached. FIG. 5 shows the bottoms flaps 12 folded perpendicular to panels 14 and 22–30. The bottom flaps 12 in the embodiment shown are attached by a strip of tape 64, with the flaps 12 for end walls 24, 26 folded inside and being overlapped by the flaps 12 for the front and back walls, 22, 28, 30. The bottom flaps 12, can also be fixed in position by adhesives or by other fastening means such as staples.

In FIG. 6, the carton 10 is position as in FIG. 5, but has be rotated upright to rest on bottom flaps 12. Carton 10 is thus positioned for filling with product, after which carton 10 can be closed.

FIG. 7 shows the carton 10 folded to a closed position. Main or central portions 56 of closure flaps 18 have been folded toward one another over the top of carton 10 to bring opposed edges 66 (see also FIG. 6) adjacent one another. The front and back flange portions (only front flange portions 52 being shown in FIG. 7) are folded down against the corresponding front or back sidewalls such that the removable closure flaps 18 define inverted-U shapes enclosing around the front, top and rear. The closure flaps 18 are fixed in position by a ring of tape 68. Closure flaps 18 are attached to end walls 24, 26 along the folds at the upper sides of carton 10.

While closed as in FIG. 7, the carton 10 is stable, substantially sealed, strong and durable enough for shipping and/or storage in inventory. Carton 10 can be stored or stacked with other cartons 10, e.g., on a pallet (not shown), and the pallet may be stacked on other similarly stacked pallets. For this purpose, the sidewalls 22–30 and partition 14 of the carton 10 in the closed state support weight. For example, it is an industry standard that classes of boxes like the carton 10 be designed to support 275 pounds (125 kilograms).

The packer can ship or transfer the carton 10 further along the distribution chain to other parties. Customarily, the closed carton 10 eventually arrives to the possession of a retailer. The retailer is free to open the carton 10 as shown in FIG. 8. The removable flaps 18 preferably are permanently severed from the left and right sidewalls 24 and 26 at the perforated or scored fold lines 34/46, which is readily possible after slitting or peeling away tape 68. Carton 10 is thus converted into a dual bin, which display and provide access to the product. Access openings 48 permit retail customers to reach into the compartments 16 through the front sidewall 22 to withdraw product from carton 10. The compartments could potentially be reached into through the open top of the carton 10, but it is preferable that the carton 10 have front openings 48, for better display and also for better access. Access through the top is limited, for example, if carton 10 is placed under a shelf close to the open top, if access is attempted by a child or short person, and front access is generally preferable.

Certain retailers also may wish to leave the top portion 56 of flaps 18 in place and merely to uncover the front openings 48. This can be accomplished by removing only front flange panels 52. In that event, cartons 10 can be easily stacked.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A plural-compartment, one-piece carton comprising:

a plurality of panels foldably attached to one another and extending between upper and lower edges;

two removable flaps foldably attached to the upper edges of two of the panels and other flaps foldably attached to the lower edges of at least some of the panels;

wherein, the carton has a collapsed state in which spaced portions of the panels are overlapped and affixed together, and in which the flaps extend generally coplanar with the attached panels;

the carton is foldable from the collapsed state to an erected state in which said other flaps are folded to and fixed in a plane perpendicular to the panels such that the panels define the sidewalls of the carton and at least one partition in the carton; and, wherein in the erected state the removable flaps are foldably attached to and permanently detachable from the carton.

2. The carton of claim 1, wherein some of the panels are formed with openings that permit access to the respective compartments of the carton in the erected state.

3. The carton of claim 2, wherein at least one removable flap comprises a main portion foldably attached to the upper edge of the attached panel and a pendent portion foldably attached to the main portion and covers at least one opening while the carton is in the closed state.

4. The carton of claim 1, wherein the panels and flaps are integrally attached portions of sheet material and define a rectangular box in the closed state with a partition dividing the box into compartments.

5. The carton of claim 4, wherein the partition is defined by a one panel which is an end one of the panels.

6. The carton of claim 1, wherein the panels and flaps are integrally attached portions of sheet material and the partition is defined by a one panel which is an end one of the panels.

7. The carton of claim 6, wherein one sidewall of the carton is defined by two panels.

8. The carton of claim 1, wherein each removable flap is foldable into an inverted-U shape.

9. The carton of claim 8, wherein some of the panels are formed with openings which permit access to the respective compartments of the carton in the erected state, which openings are coverable by the removable flaps while the carton is in the closed state.

10. The carton of claim 1, wherein the removable flaps are foldably attached along weakened portions of the carton, which weakened portions are at least one of compressed, scored and perforated.

11. The carton of claim 1, further comprising a strip of tape to fix said other flaps in position while the carton is in the open and closed states.

12. The carton of claim 1, further comprising a strip of tape to fix the removable flaps in position while the carton is in the closed state.

13. The carton of claim 1, further comprising means for affixing the spaced and overlapping portions together, said means comprising one of adhesive, glue, a plurality of fasteners, and a plurality of staples.

* * * * *

UNITED STATES PATENT AND TRADEMARK OFFICE

CERTIFICATE OF CORRECTION

PATENT NO. : 5,413,276

DATED : May 9, 1995

INVENTOR(S) : Phil B. Sheffer

It is certified that error appears in the above-indentified patent and that said Letters Patent is hereby corrected as shown below:

In the title, delete the word "COMPONENT" and insert therefor —COMPARTMENT—.

Signed and Sealed this

Fifth Day of September, 1995

*Attest:*

*Attesting Officer*

Bruce Lehman

BRUCE LEHMAN

*Commissioner of Patents and Trademarks*